United States Patent [19]

Oppenheim

[11] Patent Number: 4,924,828

[45] Date of Patent: May 15, 1990

[54] METHOD AND SYSTEM FOR CONTROLLED COMBUSTION ENGINES

[75] Inventor: A. K. Oppenheim, Berkeley, Calif.

[73] Assignee: The Regents of the University of California, Oakland, Calif.

[21] Appl. No.: 315,403

[22] Filed: Feb. 24, 1989

[51] Int. Cl.[5] ..... F02B 3/06

[52] U.S. Cl. ..... 123/299; 123/304; 123/305

[58] Field of Search ..... 123/299, 304, 305, 301, 123/300, 119, 25 C, 575

[56] References Cited

U.S. PATENT DOCUMENTS

| | | | |
|---|---|---|---|
| 4,543,930 | 10/1985 | Baker | 123/299 |
| 4,548,172 | 10/1985 | Bailey | 123/298 |
| 4,612,898 | 9/1986 | Steiger et al. | 123/299 |
| 4,748,949 | 6/1988 | Steiger et al. | 123/299 |
| 4,811,706 | 3/1989 | Grudan | 123/299 |

*Primary Examiner*—Raymond A. Nelli

*Attorney, Agent, or Firm*—Robert W. Mulcahy; Robert J. Henry; Berthold J. Weis

[57] ABSTRACT

A system for controlling combustion in internal combustion engines of both the Diesel or Otto type, which relies on establishing fluid dynamic conditions and structures wherein fuel and air are entrained, mixed and caused to be ignited in the interior of a multiplicity of eddies, and where these structures are caused to sequentially fill the headspace of the cylinders.

26 Claims, 5 Drawing Sheets

METHOD AND SYSTEM FOR CONTROLLED COMBUSTION ENGINES

FIELD OF THE INVENTION

This invention relates to a new method and apparatus for executing combustion in internal combustion engines both the premixed (Otto) and non-premixed (Diesel) charge so that instead of flame fronts traversing the charge, a characteristic feature of the current state of the art, it is carried out by having combustion take place in the interior of turbulent plumes created by jets injected into the working fluids within internal combustion engine cylinders.

The U.S. Government has rights to this invention pursuant to contract DE-AC03-76SF00098 between the U.S. Department of Energy and the University of California for the operation of Lawrence Berkeley Laboratory.

BACKGROUND OF THE INVENTION

In conventional reciprocating-piston, internal-combustion engines the process of the evolution of exothermic energy (heat release) is accomplished by a flame traversing the combustion chamber. In a gasoline engine it is a turbulent flame propagating across the charge. In a diesel engine it is a diffusion flame which is usually established as an envelope around a cloud of evaporating fuel spray (the so-called group combustion mode). As a consequence, in both cases the spatial and temporal distribution of the specific exothermic power (rate of heat release per unit mass of the working substance), as well as the residence time of reacting particles in the zone of the most effective chemical activity (region of significant concentration of active radicals) are virtually beyond control. This is exacerbated by the fact that the expansion due to the deposition of the exothermic energy in the reacting medium tends to expel the reacting particles prematurely from this zone. The reason for this is that a close coupling between the exothermic region of chemical activity with the flame front is essential to assure a sufficiently high rate of flame propagation so that combustion is completed within the relatively short time interval required for proper operation of the engine.

In conventional premixed charge or gasoline (Otto) engines combustion is initiated by forming a flame kernel whose front thereupon sweeps across the working substance. The important point is that after ignition takes place, the combustion process spreads through the head space at its own natural speed, essentially beyond any further control. The specific exothermic power as well as the residence time of the reacting species in the zone of the essential chemical activity are virtually uncontrolled.

In conventional non-premixed charge or diesel engines, liquid fuel is injected into piston-compressed air at an appreciable inlet velocity. Upon entering the combustion chamber, the fuel is atomized into a set of droplets whose number density is high enough to form a cloud of sufficiently densely spaced fuel droplets for the flame to become established as an envelope around it. Its front is then driven across the compressed air charge as a consequence of the momentum imparted upon the spray in the course of its formation by the injector, an action leading often to the detrimental effects of fuel wetted cylinder walls.

The establishment of the front of a diffusion flame front as an envelope of a spray is technically referred to as its group combustion mode. Under such circumstances oxygen is completely depleted inside the flame envelope while fuel is fully consumed at the front. As a consequence, maximum temperature the fuel is capable of reaching by combustion in air, is actually achieved at the flame front, stabilizing the process of combustion. This maximizes, however, the formation of nitric oxide and, in approaching this high temperature zone in the absence of oxygen, fuel is pyrolized to generate soot. Moreover, as a consequence of imperfections due to the relatively narrow zone of the exothermic power pulse associated with the essential chemical activity concentration at the front, optimum conditions are attained for the generation of carbon monoxide and the formation of a residue of unburnt hydrocarbons. In essence then, the combustion system acquires automatically the most favorable conditions for the generation of all the known pollutants.

To make matters worse, in order to assure good contact of fuel with air, using the conventional system of a single injector per cylinder, one has to rely on the momentum of the spray in order to drive the flame across the compressed air charge. Created thus is the familiar noise of diesel engines and the concomitant tendency to knock, creating the demand for fuels of a relatively high cetane number, that is fuels that autoignite relatively fast to keep up with the flow rate at which they are injected into the combustion chamber.

SUMMARY OF THE INVENTION

The present invention provides a solution to the quest for controlled combustion in internal combustion engines. The invention exploits a fluid mechanical phenomenon which has been studied extensively over the last fifteen years and become known as a turbulent free shear layer. As revealed thereby, such a layer is made out of a characteristically interlaced sequence of large scale eddie, acting as whirlpools that are instrumental in intermixing the media between which it is situated. The essence of the invention is to take advantage of the fact that pulsed jets create plumes whose internal structure is essentially akin to a turbulent shear layer.

For the present purpose the media of the jets injected into the head space are:

(1) in the case of a premixed charge engine, a stream of hot products of incomplete combustion of a rich mixture burned in the cavity of the generator plug, acting as a reagent for combustion of the appropriately lean air/fuel mixture compressed in the cylinder head space that constitutes the charge. "Rich" means excess of fuel with respect to the so-called stoichiometric proportion when the amount of oxygen provided with air is theoretically just sufficient to produce fully saturated oxides, that is, in the case of hydrocarbon fuels, carbon dioxide and water molecules; "lean" means excess of air with respect to the stiochiometric proportion. The preferred excess of fuel in the cavity is of an order of 50%. The preferred excess of air in the charge can be up to 50%; or, preferrably about 25% excess air combined with approximately an equal amount of recirculated products of combustion (exhaust gas or residual gas) and (2) in the case of a non-premixed charge engine, air stream carrying fuel droplets acting as the charge which is ignited by contact with the high temperature air compressed in the head space providing thus the service of a reagent.

The preferred function of the jet plume is then as follows:

The phenomena taking place in the plume are associated with the fact that the essential process of combustion does not occur instantaneously and immediately upon the contact of the charge with the reagent. For the exothermic process, or heat release, to take place, a preparatory action of what is known as the induction process is necessary. In its course, molecular intermixing between the media of the charge and the reactant is accomplished by diffusion, while the concentration of active radicals acting as chain carriers attains the threshold level to usher in the chain branching and recombination processes, the latter yielding saturated oxides, the ultimate product of combustion whose formation is associated with the evolution of exothermic energy. The period of time taken up by the induction process is long enough to cause physical separation between the exothermic zone and the interface where the initial contact between the charge and the reagent takes place. In a turbulent shear layer, such as that formed by a pulsed jet generating a plume, the most likely places for the exothermic process to occur are the kernels of eddies, because they are associated with the most vigorous mixing. By proper control over the composition of reacting media, the process is then executed so that the initiation of combustion, as well as its exothermic process, take place in the interior of the eddies, assuring thus proper operation of the system.

One of the key aspects of the present invention is to inject into the head space of an internal combustion engine a plurality of such jets of reactants to form a number of such plumes. These jets are injected with a spatial distribution such that the plumes formed by them fill, upon completion of combustion in their interiors, a substantial fraction of the head space in the engine cylinder when the piston is approaching top dead center. The temporal distribution of the jets is over externally (microprocessor) controlled time intervals towards the end of the compression stroke of proper durations to develop optimum pressure rise without causing explosion or knock. The conventional process of combustion accomplished by the natural process of flame front propagation is thereby replaced by an externally controllable system whereby combustion reactions take place within a set of eddy structures within turbulent plumes of sequentially introduced pulsed jets. The full volume of the cylinder head space is then eventually filled by a plurality of such plumes. The development of flame fronts is thus significantly inhibited and the normal burning speed of a flame which dominates the conventional combustion process is rendered therefore irrelevant. The present method of combustion control essentially relies on the fluid mechanical eddies to execute combustion everywhere, but in a delicately controlled sequential fashion, achieved by timing externally the jet ignition signal. The entire process of combustion is carried out then within a proper time interval so that it is accomplished within a period of time comparable to that taken by the flame front propagation Objects, advantages and benefits of the invention include:

1. Premixed charge (Otto) engines are provided with a capability to operate with lean mixtures diluted by recirculated combustion products—a feature inhibiting significantly the tendency to knock, as well as making feasible their part-load operation at wide open throttle, i.e. modulating the work output of the engine entirely by varying the air/fuel ratio and hence significantly improving fuel economy.

2. Non-premixed charge (Diesel) engines are equipped with a device to mix fuel with air before the exothermic process of combustion takes place, reducing thereby significantly the formation of pollutants, in particular the smoke generating particulates.

3. Optimum conditions are established for the execution of chemical reaction by the system of the essentially well stirred reaction zone formed by the large scale, whirlpool-type, eddy structures of which the plumes, produced by the pulsed jets, consist. Moreover, this combustion mode lends itself to the introduction of suitable chemical additives to stimulate or inhibit the reaction as required for proper execution of the process of combustion in terms of its performance as a controlled chemical reactor, that is, a system devoid of undesirable molecular composition of the effluent stream.

4. All sorts of combustion instabilities, in particular the tendency to knock are effectively restrained. This property fosters fuel independence that makes the engine tolerant to a wide variety of fuels.

PREMIXED CHARGE OR OTTO ENGINES

As specified above, the invention is generally applicable to internal combustion engines. Its key concept is that, instead of having to rely upon a flame traversing the charge, the process of combustion is performed within turbulent plumes created by a plurality of jets of burnt gases, produced by combustion of rich mixtures in cavities of generator plugs, directed into different segments of the cylinder head space. Details of such jet generators are described further below and also in copending patent application "Pulse Jet Plume Combustion Generator for Premixed Charge Engines" by A. K. Oppenheim, K. E. Stewart, and K. Hom which is incorporated herein by reference.

The charge in the head space of a premixed charge engine is conceptually treated as if it consisted of a number of regions, combustion in each of them being accomplished by a plume consuming its contents in its entirety. The progress of the process is thus governed by the size of each plume and the timing of its jet generators.

Jets for producing such plumes are best generated by combustion of rich fuel/air mixtures in confined prechambers, adjacent to, and or occupying part of the head space, ignited typically by means of an electric spark. Orifices in these prechambers direct the jets into the desired regions of the head space. The orifices are, as a rule, sharp edged in order to conserve active radicals in the stream by minimizing their recombination promoting collisions with the walls. The ignition of the reactants leads to a rapid rise in pressure in the confined prechamber, expelling the combustion expanded medium it contains in the form of a jet or jets through orifices in desired direction. The jet streams then form turbulent plumes. The plumes consist of a sequence of large scale, whirlpool type eddy structures which entrain (inhale) the fuel/air mixture of the charge into their interior. Combustion takes place inside these eddies upon ignition by contact with the hot medium of the jets issuing from the prechambers of the generator plugs. Control of the rate and extent of the combustion process in the head space is readily obtained by managing (1) the amount and nature of the reactants introduced into the prechamber, and (2) timing of their ignition.

The preferred arrangement involves the use of pulsed jet combustion (PJC) generators, generally sparkplug size devices, a plurality, say two to about six, of which are threaded into the cylinder head. Each such generator comprises one or more orifices directed into a desirable region of the head space. Each generator defines a prechamber of about 1 cc, or 0.05–0.1 $in^3$, in volume. Generally, the total volume of the prechambers is between about 3% and 10% of the minimum volume of the head space. Individually controllable, valved reactant supply lines permit the introduction of desired reactants in preferred quantities and at appropriate times into the prechamber. Also associated with each generator is an electric power supply and electrodes for producing a spark discharge at the desired time. While PJC generators may employ mixtures of a wide variety of hydrocarbons and/or alcohols with air, the latter are of particular interest because of anti-fouling properties of their combustion products.

NON-PREMIXED CHARGE OR DIESEL ENGINES

In accordance with the present invention, control over the combustion process in non-premixed charge engines is attained by the same basic approach of exploiting the fluid dynamic structural properties of jet plumes to execute the combustion process. Again the head space of the cylinder is conceptually divided into a plurality of regions, into each of which is directed a jet comprising relatively low temperature air carrying liquid fuel that is atomized into small droplets. The jets in turn generate plumes, consisting, as before, of a sequence of turbulent, whirlpool-type eddy structures which entrain (inhale) the relatively high temperature, piston-compressed air. Ignition takes place upon contact with the entrained hot air and the resulting combustion zones are constrained within the kernels in the interior of the eddy structures, inhibiting the formation of a flame envelope around the spray, the characteristic feature of the group combustion mode, and thus preventing the production of particulates (soot).

Preferred jet plume generators for diesel engines are described in detail in a pending U.S. Patent Application entitled "Pulsed Jet Combustion Generator for Non-Premixed Charge Engines" by A. K. Oppenheim and H. E. Stewart. These plume generators employ controllable, valved pressurized air and fuel supply lines to form air jets carrying highly atomized fuel particles, approximately 10 micrometer size or less, for example. Each cylinder is outfitted with a plurality of such generators, between two to about six in number, whose orifices are aimed at neighboring segments of the cylinder head space volume. Again, control over the combustion process is achieved by adjusting the quantities and sequential timing of the reactants introduced thereby into the head space, by adjusting the pressure, relative proportion of fuel to air, and time of the release of a pintle valve causing injection of the stream of air with fuel droplets into the cylinder. For non-premixed charge engines the driving force for forming appropriate turbulent jet plumes is thus the momentum of the compressed air governed by pintle valve release action, rather than the rate of combustion in the cavity of the generator, as is the case in premixed charge engines. In other words, the timing of jet formation is then accomplished mechanically by the action of a pintle valve, admitting the jet into the cylinder, rather than by the timing of the electric spark discharge for igniting the reactants in the cavity and their composition in a jet generator for premixed charge engines.

BRIEF DESCRIPTION OF THE DRAWINGS

The nature of the inventive subject matter and its advantages become more apparent upon consideration of the following description of the preferred embodiments which are illustrated in the following drawings, in which.

DESCRIPTION OF THE PREFERRED EMBODIMENTS

Figure 1:
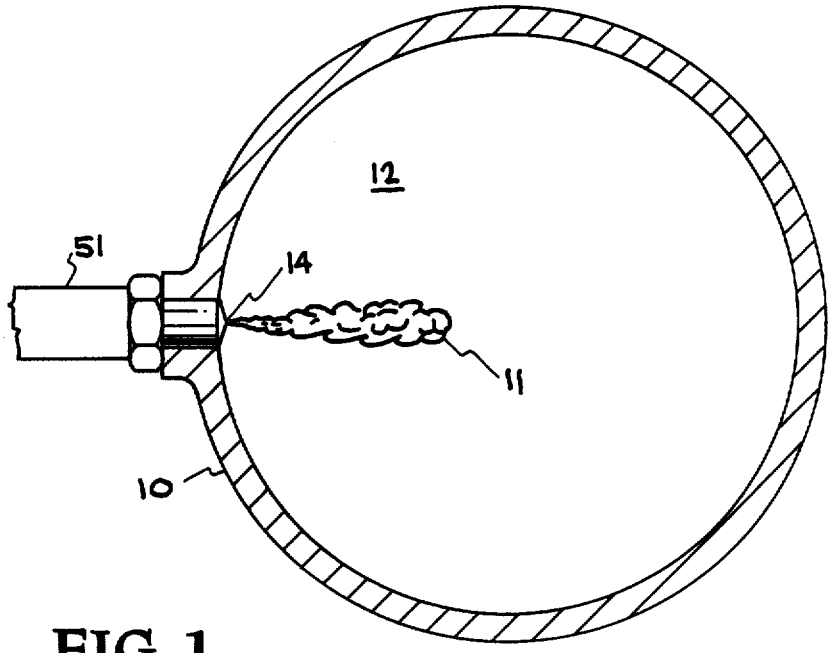
FIG. 1 shows a representative turbulent plume at an early stage of development upon injection of a pulsed jet into a region of the head space of a cylinder.

An important aspect of the invention is the nature of the flow structure of the plumes. Turbulent jet plumes, such as shown in FIG. 1, have the attribute of entrainment, the capability to inhale the surrounding medium into their midst. According to experimental measurements, for a pulsed jet, the mass ratio of entrained gas to that of the initiating jet can reach values as high as 10.

Figure 2:
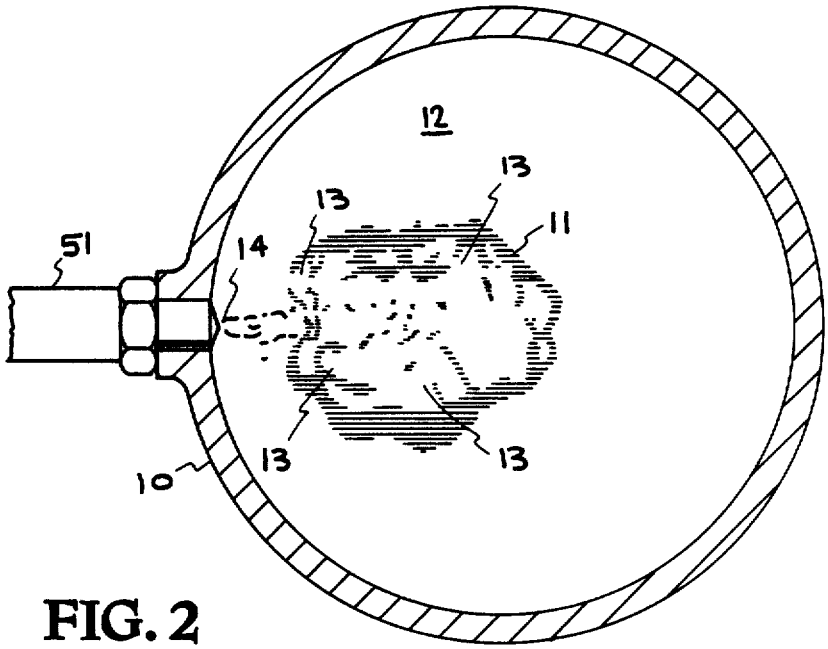
FIG. 2 shows the plume towards the end of its function as a well-stirred reactor when the bulk of the exothermic process of combustion has taken place in its interior.

One of the key ideas of the invention is the concept that this property can be exploited to have the exothermic process of combustion, its essential element, take place in the interior of the turbulent plume created by a pulsed jet, rather than having it accomplished by a flame traversing the charge, as is usually the case. As a consequence of exothermicity, the plume increases in size, acquiring an expanded shape as depicted in FIG. 2. Following this stage, further propagation of combustion could be performed by propagating flames established at the contours of the plume of FIG. 2, but this is prevented by the intervention of other plumes. The whole process of combustion is executed then by a suitable number of jet plumes activated sequentially, rather than by means of a traversing flame or a single plume. It is this feature that constitutes the unique aspect of this invention.

FIGS. 1 and 2 schematically illustrate cylinder walls 10, confining medium 12, comprising either a—air fuel mixture, or compression heated air, into which jet 14 is propelled at relatively high exit velocity from the orifice of the generator 51. FIG. 1 shows the contours of the plume 11 at an early stage of its formation, and FIG. 2 shows the plume at the end of its useful function, after the exothermic reaction in its interior has caused expansion manifested by the deformation of the outer boundary 13.

With reference to FIGS. 1 and 2 the sequence of events in a premixed charge system, taking place in the course of combustion in a jet plume, is thus as follows:

At first, as a consequence of shear it encounters as it exits the orifice, the medium of the hot jet 14 behaves essentially as a chemically inert substance. Under proper operating conditions of momentum pulse, it forms than a plume 11 as shown in FIG. 1. Internally, its flow field consists of vortex nodules, or kernels, displaying the today well known large scale eddy structure of a turbulent shear layer. By virtue of their internal recirculation pattern the nodules behave as whirlpools, with all the advantages of heat and mass transfer they can exert, providing, therefore, optimum sites for chemical reaction to take place. They act then, in effect, as well stirred reactors.

As the region of the exothermic process of combustion occurring in the interior of the plume progresses, its outer boundary expands as shown in FIG. 2. At that stage enough time has elapsed from the onset of the plume for a flame front to become established at its periphery, while the unburnt medium it entrained became consumed by combustion. Under such circumstances the plume becomes a puff, a cloud that grows solely as a consequence of the action of the flame fronts at its boundaries. The influence of the jet is then essentially terminated and so is the active life of the plume as the motive force for entrainment.

The most important consideration in the practical realization of the invention is thus to prolong the life of the plumes as much as possible, and, at the time, reduce the life span of the puffs to the minimum, all of which is controllable by the combustion of the reacting media, as well as the functional parameters which affect the jet performance.

In a premixed charge engine, the interface at the outer boundary may give rise to a flame front which could propagate through the remainder of the burnt medium in the regions outside of the plume. However, besides the fact that the composition of the charge is too close to extinction limit to support flame propagation, this is prevented by providing other PJC generators which inject other plume forming jets into these regions before this event takes place. Thus the process of combustion is accomplished by a sequence of consecutively activated PJC generators, rather than by a self-propagating flame as in conventional internal combustion engines. Each PJC fulfills its task within an assigned time interval and within a proper region of space in the combustion chamber.

Figure 3A:
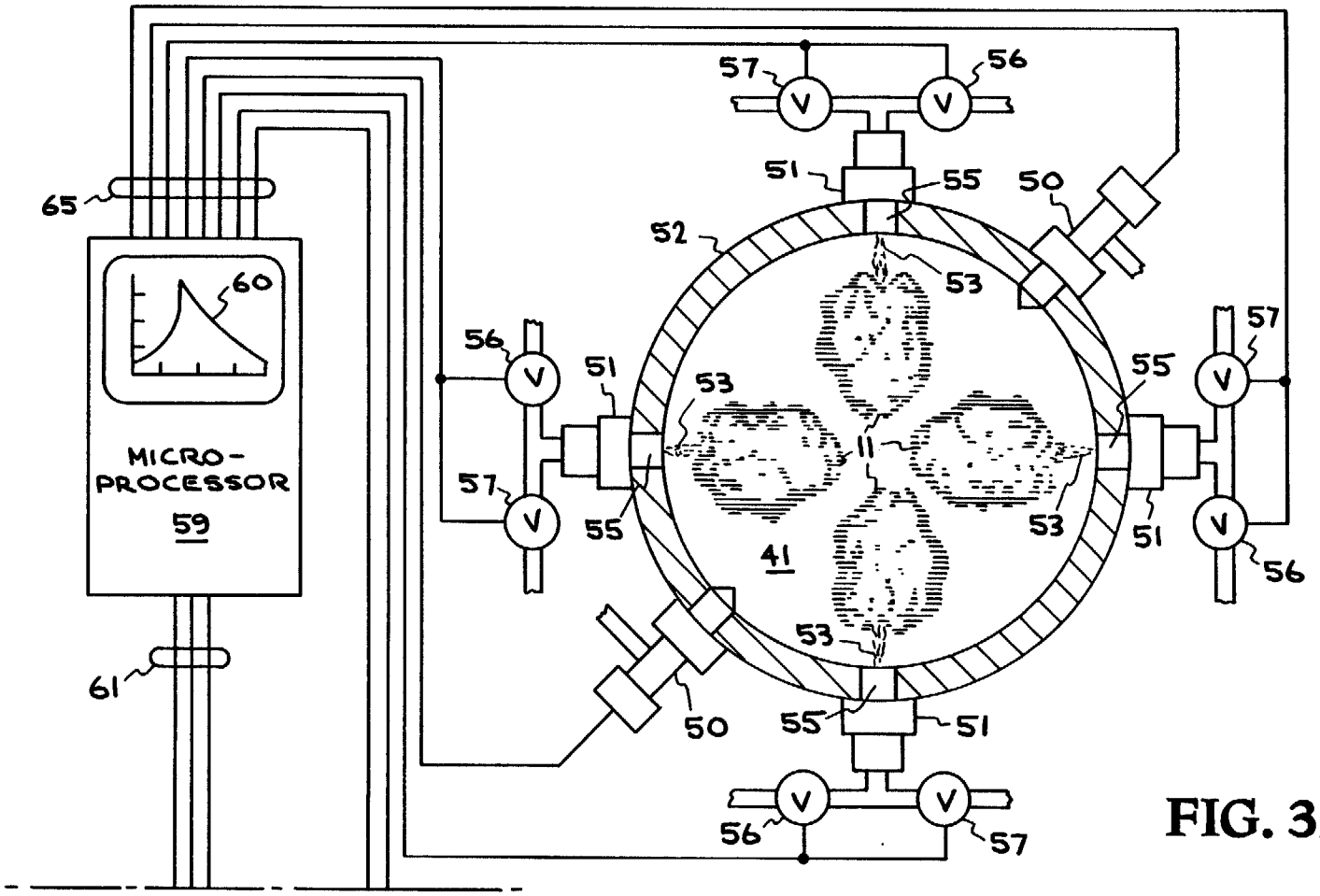
FIGS. 3*a* and *b* illustrate the application of the invention to a premixed charge (gasoline Otto) engines, FIG. 3*a* showing an engine cylinder in horizontal cross section and FIG. 3*b* in vertical cross section, along with the schematic illustration of an appropriate jet generating system with the concomitant microprocessor control apparatus.
Figure 3B:
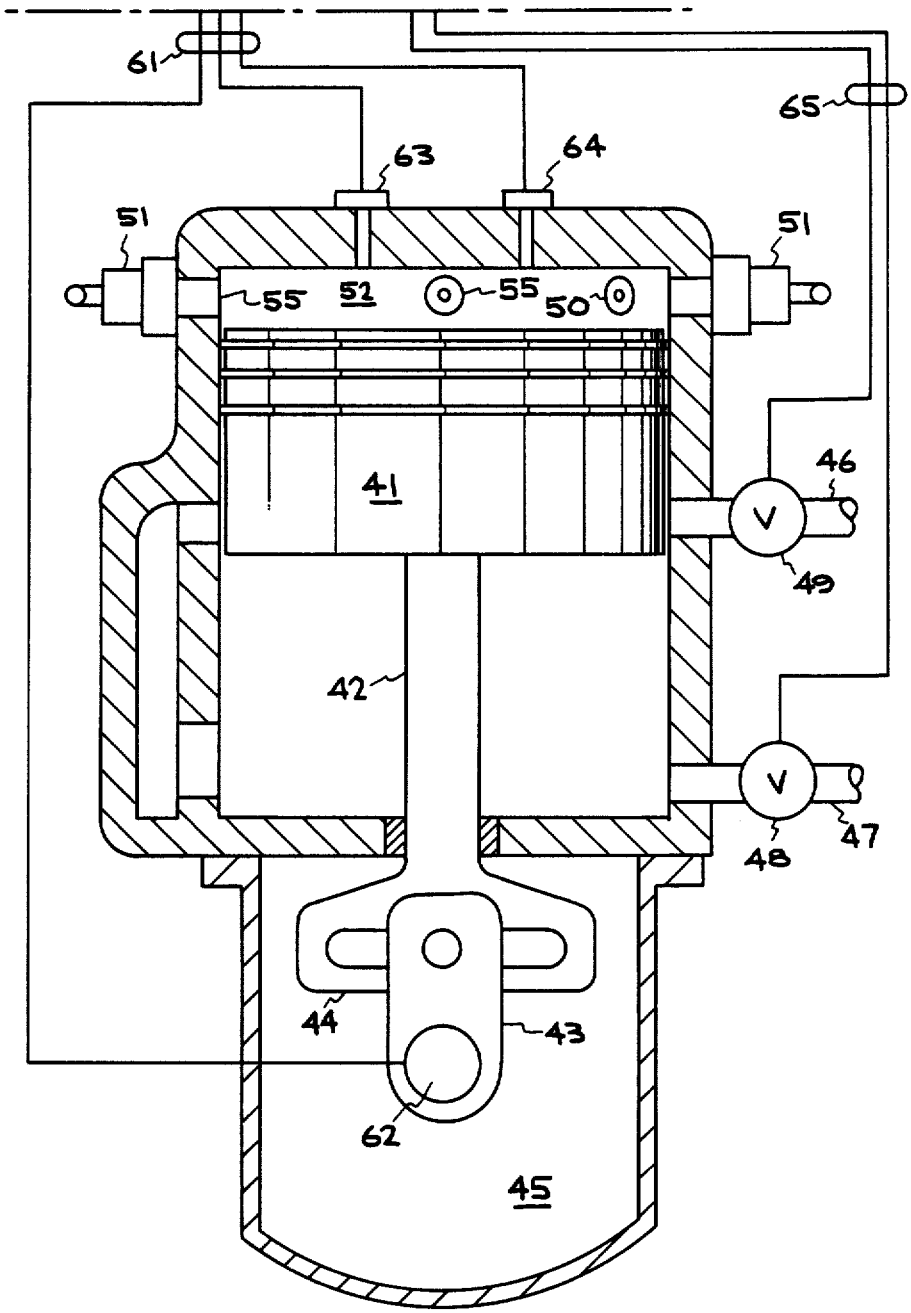

FIGS. 3*a* and *b* show an exemplary controlled combustion system for a premixed charge engine. It should be pointed out that although the present concept of combustion control is applicable to two-as well as four-stroke engines, its practical advantages are realized to a greater extent in two-stroke engines, primarily because they provide an excellent countermeasure to the necessity of diluting the charge in order to impede the formation of flames. The engine described represents a somewhat advanced but essentially standard state-of-the-art two-stroke engine, which per se is not a part of this invention. However, in combination with the combustion control system according to the present invention such an engine will possess all the attributes enumerated earlier, i.e. flexible, fully controllable operation maximizing fuel economy, minimizing pollutant emission, and optimizing fuel tolerance.

With reference to FIGS. 3*a* and *b*, piston 41 is connected by means of rod 42 to crankshaft 43 using a scotch yoke type linkage 44 as an example of a two stroke engine employing a sealed crank case 45 and gas lubricated pistons provide sealed cylinder space below the piston to compressed scavenging air, as well as to minimize the influence of crank case oil upon the formation of unburnt hydrocarbons.

Air inlet port 47 has a controllable reed check valve 48 to obstruct back flow to make the bottom part of the cylinder act as a piston activated compressor. The exhaust port 46 is outfitted with a variable outlet aperture 49 to control the amount of the inlet air, as well as the thermodynamic state and composition of the charge, as governed by the fraction of recirculated products of combustion retained from pervious cycle. Conventional injectors 50 introduce fuel into the cylinder at the start of the compression stroke.

Four pulsed jet plume combustion generators 51 are mounted in the top portion of the cylinder wall 52. Their exit orifices 55 are disposed to sequentially direct jets 53 of pre-ignited fuel and air mixtures into different regions of the head space to generate plumes therein. As indicated above, our copending patent application "Pulse Jet Generator for Premixed Charge Engines" by A. K. Oppenheim et al describes a preferred pulsed jet combustion generator system for premixed charge engines in detail and is incorporated herein by reference.

The operation of the engine, including the PJC generators, can be controlled in a variety of ways. For example, one can provide a conventional distributor type control device (not shown) which is mechanically geared to the crankshaft in a per se known fashion. However, the preferred control system is based on microprocessor technology and is illustrated schematically in the drawing. The microprocessor 59 is programmed to issue its commands as a function of crankangle CA and pressure P of the medium in the cylinder, as graphically illustrated by trace 60. The engine condition data inputs 61 are continuously provided to the microprocessor by crankangle encoder 62, and pressure tranducer 63. The numeral 64 schematically indicates one or more alternate sensors, which may serve to provide an additional reference for programming the command signal, i.e. it may be used for sensing incipient instability such as knock, concentration of pollutants such as nitric oxide, or for redundancy to safeguard against primary sensor failure. Such sensors could measure flame luminosity or ionization pulse, piston acceleration, heat transfer, or the like.

At appropriate values of the input data, the microprocessor then issues its output commands 65. In particular, these commands comprise signals for opening and closing the primary and secondary solenoid activated reactant supply valves 56 and 57 for the PJC generator and the electric discharge for ignition in the cavity of the PJC generator. Reactants for use in the PJC generator can be gaseous or liquid hydrocarbons and/or alcohols, such as methanol air mixtures, the latter especially, because of the anti-fouling properties of their combustion products. In principle the particular kind of fuel used in the PJC generator is independent of the main engine fuel.

The quantity of feedstock admitted into the prechamber of the PJC generator 51 depends on the pressure of the reactant supply and the length of time valves 52 and 53 remain open. These valves are shown to be operated in tandem, but could be individually controlled. It is preferable to dimension supply lines to meter and deliver an appropriate fuel rich reactant mixture to the PJC generator as well as to provide an ample concentration of radical species in the effluent stream to ensure ignition and jet formation. The valve signal pulse length thus determines delivery of the correct quantity. The jet is formed by causing the PJC generator reactant mixture to ignite in the prechamber. This is accomplished by an electric discharge in the prechamber executed in response to firing signals in the output signal command set 65. Note that ignition in the 4 PJC generators is individually controlled. This is so because the preferred mode of operating the PJC generators is to form the reacting plumes independently influencing thereby the rate of pressure rise in the combustion chamber to assure optimum momentum transfer rate to the piston.

Another command of the set 65 operates the conventional main fuel injectors 50. As mentioned above, the main fuel may be different than the PJC reactants and could normally be gasoline, methanol or their suitable mixture. In view of the reliable control afforded by the present combustion system, generally the quantity of fuel injected would be such as to provide a lean mixture, the diluent consisting of excess air mixed with recirculated combustion products.

Other commands in the output signal in the command set relate to operating the air intake and exhaust outlet controls, 48 and 49 respectively, the former a reed valve and the latter a variable area diaphragm, to control the amount of residual gas recirculation.

Figure 4A:
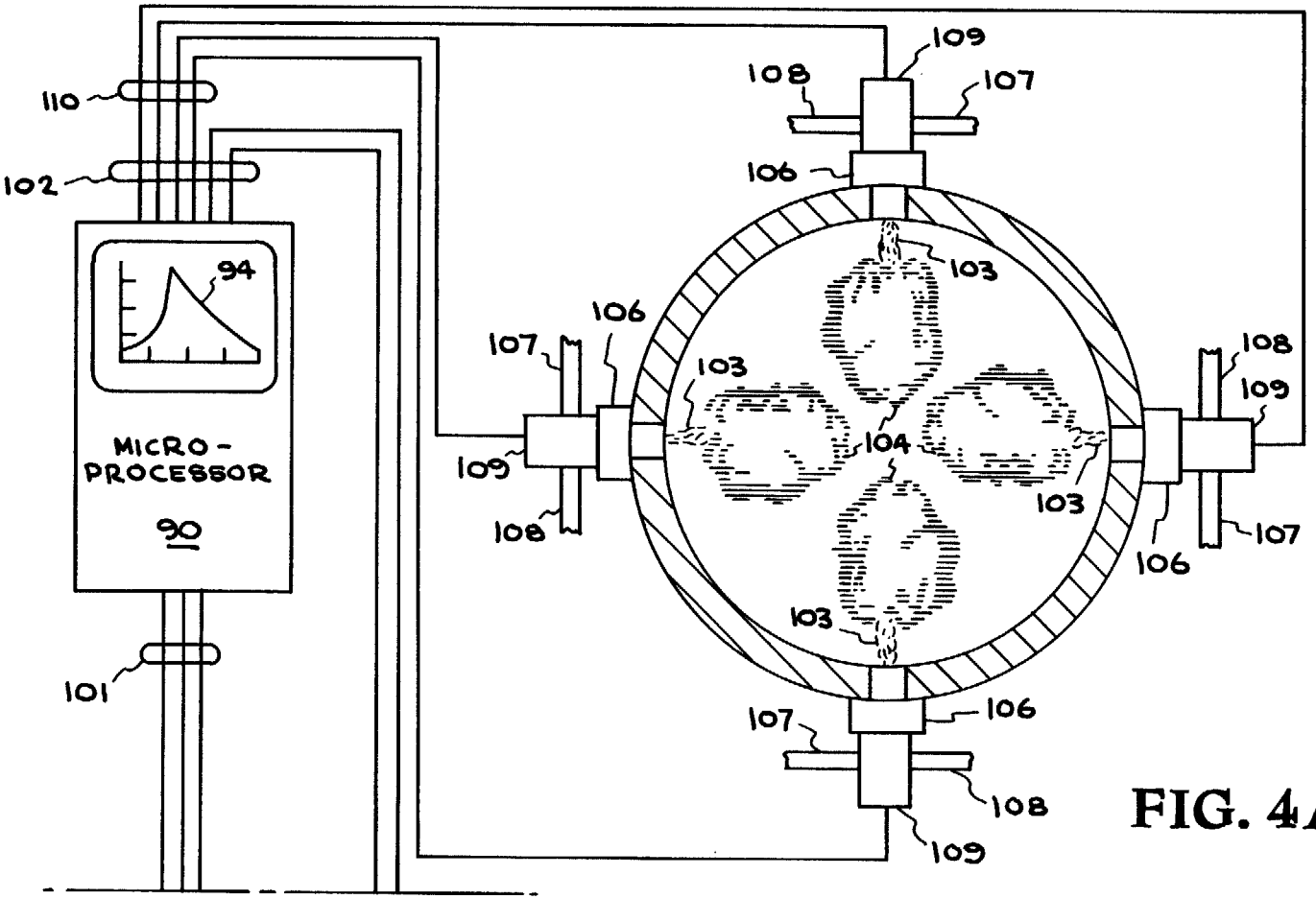
FIGS. 4*a* and *b* illustrate the application of the invention to a non-premixed charge (Diesel) engine, with FIG. 4*a* showing an engine cylinder in horizontal cross section, and FIG. 4*b* in vertical cross section, together with a schematic illustration of an appropriate jet generating system with the concomitant microprocessor control apparatus.
Figure 4B:
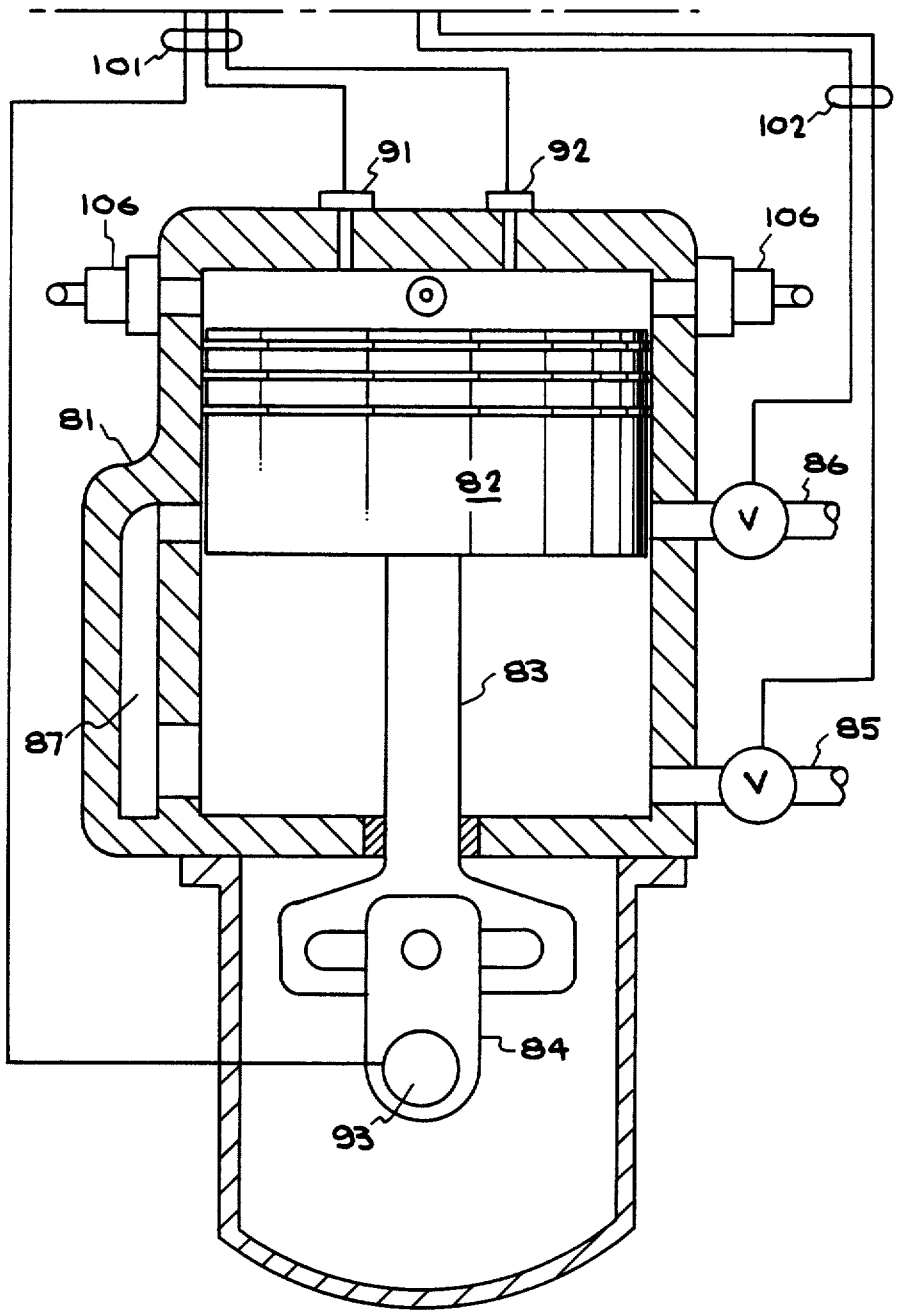

FIGS. 4*a* and *b* show an exemplary embodiment of the present combustion control system applied to non-premixed charge or Diesel engine. This system is similar to the premixed charge engine configuration in that the basic engine components comprising case 81, piston 82, rod 83, crankshaft 84, air inlet port 85, exhaust port 86, bypass duct 87, are all similar. The salient differences are that the engine is dimensioned to achieve a high compression ratio required to heat the air above the ignition temperature of the fuel, and that all the fuel is injected immediately prior to the instant of preferred auto-ignition.

The preferred control system is also similar in that it is comprised of a microprocessor 90 which receives input signals 101 from pressure sensor 91, alternate sensor 92, and crankangle encoder 93 to provide the input data which indicate engine condition. The microprocessor then issues a set of output signals 102 whose timing and duration are a function of engine condition, as indicated by the graphical representation 94.

A set of four PJC generators 106 produce jets 103 which are directed into different regions of the head space, are actuated sequentially by a subset 110 of output signals 102, and produce jets 103 forming plumes 104 to carry out the combustion process as described earlier, i.e. by entraining hot air into the plume interior as the reagent causing combustion to take place in the eddy interiors.

The set of the PJC generators in an engine cylinder, preferably 2–6 in number, must introduce all the fuel required for the combustion process. A preferred PJC generator for non-premixed charge engines is the subject of copending patent application "Pulsed Jet Combustion Generator for Premixed Charge Engines" by A. K. Oppenheim, and H. E. Stewart, which is incorporated herein for reference. The generator essentially forms a plume of fuel in a finely atomized form carried by an air stream. The generators 106 receive fuel through fuel lines 107 while the high pressure air required for injection is withdrawn from the cylinder, cooled, and, upon pressure intensification, introduced through tubing 108. Injection is controlled by a solenoid controlled needle valve mechanism 109, responsive to signals received through channels 110.

The pressure of the air supply is adjusted so as to provide the high velocity flow required for appropriate jet and plume formation. It is desirable to disperse the fuel in the air stream as finely as possible. The preferred generator disclosed in the above cited application achieves sufficiently small droplet sizes by shearing the fuel with a high pressure air stream in the orifice region of the generator whereby the fuel is atomized into fine droplet embodied within the air carrier.

Having thus described the invention, it will be appreciated by those skilled in the art that numerous modifications may be made without departing from the spirit of the invention, whose scope should therefore be limited only by the following claims:

What is claimed is:

1. A method for executing the combustion of reactants in internal combustion engines, which comprises the steps of:

compressing a gaseous working fluid, comprising at least a part of one or more said reactants;

sequentially injecting into said gaseous working fluid, at predetermined time intervals upon at least partially compressing said working fluid, a plurality of jets comprising the balance of said reactants under conditions leading to the formation of a plurality of plumes, each of said plumes having a fluid dynamic structure comprising a multiplicity of eddies entraining reactants from said working fluid and causing said reactants to be mixed within the interior of said eddies of said plumes; initiating thereupon the exothermic process of combustion to proceed in the interior of said plumes, each of said plurality of plumes occupying a fraction of the volume containing said working fluid, and the totality of plumes occupying upon their expansion due to the exothermic effects of combustion, essentially the entire head space.

2. The method of claim 1, wherein said internal combustion engine if of the premixed type, and wherein said working fluid comprises air and hydrocarbon fuel, and wherein said jets comprise products of combustion of fuel and air in a pre-combustion chamber, within an appropriate jet generator plug, to act as the reagents for initiating combustion reactions in the interior of said eddies.

3. The method of claim 2, wherein said jets are products of combustion of gasoline or methanol and air.

4. The method of claim 3, wherein the mixture of said air and hydrocarbon fuel in said working fluid contained in the engine cylinder is lean by virtue of excess air and mixed with a diluent consisting of recirculated combustion products, whereas the mixture of said fuel and air in the pre-combustion chamber, contained within the plug employed for the generation of said jets, is fuel rich.

5. The method of claim 2, wherein said plurality of jets is comprised of groups of jets, each jet in each of said groups being injected simultaneously with the other jets in the same group, by being issued from the same pre-combustion chamber and wherein said groups are injected independently during a predetermined time interval at the optimum time for ignition near the end of the compression stroke.

6. The method of claim 2, wherein the number of plugs is between two and six.

7. The method of claim 1, wherein said internal combustion engine is of the non-premixed charge type and wherein said gaseous working fluid contained in the engine cylinder comprises air, and wherein said jets comprise fuel dispensed in a carrier stream of compressed air, and wherein said reagent for initiating combustion reactions in the interior of said eddies is said air of said working fluid, contained in engine cylinder, having been heated to a temperature sufficient to cause combustion of said fuel in the interior or said eddies.

8. The method of claim 7, wherein said plugs generate between 1–6 jets directed into separate distinct regions of the head space.

9. The method of claim 7, wherein said plurality of jets are injected independently during an appropriate time interval near the maximum compression of said working fluid.

10. The method of claim 9, wherein said time interval is determined by sensing engine conditions.

11. The method of claim 10, wherein said engine conditions are selected from one or more parameters of crank angle marking the position of the piston, pressure of the working substance in the cylinder head space, temperature of the working substance, concentration of representative chemical species indicative of the chemical composition of the working fluid, luminosity, or ionization signal generated in the course of the exothermic process of combustion.

12. The method of claim 10, wherein engine conditions are sensed, signals indicative of said engine condition compared with a set of predetermined engine condition data indicating optimal combustion characteristics, and wherein signal commands for jet formation are issued in response thereto.

13. The method of claim 8, wherein the number of jets is one of 4 or 8.

14. The method of claim 1, wherein said internal combustion engine is a two stroke engine of the premixed charge type.

15. The method of claim 1, wherein said internal combustion engine is a two stroke engine of the non-premixed charge type.

16. Apparatus for executing the combustion of reactants in internal combustion engines wherein gaseous working fluids comprise at least a part of one or more of said reactants, and are compressed and burned in the head space of a piston and cylinder arrangement, comprising:

at least two means for forming and injecting into distinct regions of said head space a plurality of jets comprising the balance of said reactants, said jets having the fluid dynamic characteristics leading to the formation of plumes within said regions of said head space, said plumes comprising a multiplicity of eddies entraining reactants from said working fluid and causing them to contact the reactants within said plumes;

and means for introducing into said plumes reagents for initiating combustion reactions between said reactants in the interior of said eddies.

17. The apparatus of claim 16, wherein said internal combustion engine is an engine of the premixed charge type, wherein said working fluid is a mixture of fuel and air, and wherein said means for forming and injecting said jets comprises a combustion prechamber having at least one exit orifice for forming said jets, in fluid communication with said head space;

means for introducing a fuel and air into said prechamber;

and means for establishing an electrical discharge through said prechamber.

18. The apparatus of claim 17, wherein said fuel and air introduced into said prechamber constitute a rich mixture.

19. The apparatus of claim 18, comprising separate fuel supply systems for introducing fuel into said working fluid and into said prechamber.

20. The apparatus of claim 17, wherein said fuel introduced into said prechamber is methanol or a mixture of methanol and gasoline.

21. The apparatus of claim 17, wherein the number of said means of injecting jets into said head space is from two to six.

22. The apparatus of claim 16, wherein said internal combustion engine is an engine of the non-premixed charge type, wherein said working fluid is air, wherein said plurality of said jets contain essentially all the fuel to be burned in said head space in the course of a working stroke of said piston, and wherein said reagent for initiating combustion is said air, contained in the cylinder and heated by piston compression above the ignition temperature of said fuel.

23. The apparatus of claim 22, wherein said means for forming and injecting said jets comprises valve means for interrupting fluid communication between said means for forming jets and said head space, and wherein said means for injecting said jets comprises means for generating a stream of high pressure air and means for disposing in said stream of high pressure air a dispersion of fuel.

24. The apparatus of claim 23, including means for cooling said air and fuel to a temperature below the temperature of the working fluid into which the jet is to be injected.

25. The apparatus of claim 23, wherein said engine is a two stroke engine.

26. The apparatus of claim 16, further including sensors for sensing engine conditions and issuing signals indicative of engine conditions;

microprocessor means operatively connected to said sensor means for receiving said signals, converting said signals into a set of command signals, and means for establishing engine operation parameters operatively connected to and responsive to said command signals.

* * * * *